US009057208B2

(12) United States Patent
Massard et al.

(10) Patent No.: US 9,057,208 B2
(45) Date of Patent: Jun. 16, 2015

(54) DUMMY LOCK CORE

(71) Applicant: Perma Core LLC, Novi, MI (US)

(72) Inventors: Robert Massard, Novi, MI (US); Eugene A. Degre, Holden, MA (US)

( * ) Notice: Subject to any disclaimer, the term of this patent is extended or adjusted under 35 U.S.C. 154(b) by 0 days.

(21) Appl. No.: 14/304,135

(22) Filed: Jun. 13, 2014

(65) Prior Publication Data

US 2015/0007624 A1 Jan. 8, 2015

Related U.S. Application Data

(60) Provisional application No. 61/834,533, filed on Jun. 13, 2013.

(51) Int. Cl.
*E05B 9/08* (2006.01)
*E05B 15/00* (2006.01)

(52) U.S. Cl.
CPC *E05B 15/00* (2013.01); *E05B 9/084* (2013.01)

(58) Field of Classification Search
CPC ..... E05B 9/00; E05B 9/04; E05B 9/084; E05B 9/086; E05B 15/00; E05B 15/0053; E05B 15/006; E05B 15/008; E05B 15/04
USPC ..... 70/375, 367–373, 451, 466, 379 R, 70/379 A, 380
See application file for complete search history.

(56) References Cited

U.S. PATENT DOCUMENTS 1,575,091 A * 3/1926 Best ..... 70/367
1,866,342 A * 7/1932 Best ..... 70/369
1,914,639 A * 6/1933 Hurd ..... 70/369
2,122,478 A * 7/1938 Liss ..... 70/369
2,199,336 A * 4/1940 Fletcher ..... 70/38 A
2,268,511 A * 12/1941 Ledin ..... 70/371
2,320,177 A * 5/1943 Golden et al. ..... 70/370
2,323,400 A * 7/1943 Jacobi ..... 70/368
2,370,862 A * 3/1945 Johnstone ..... 70/367
2,457,650 A * 12/1948 Dyson ..... 70/38 A
3,009,349 A * 11/1961 Check ..... 70/369
3,324,693 A * 6/1967 Check ..... 70/369
3,713,311 A * 1/1973 Oliver et al. ..... 70/369
3,793,856 A * 2/1974 Lippisch ..... 70/38 A
4,328,690 A * 5/1982 Oliver ..... 70/369
4,620,430 A * 11/1986 Latone ..... 70/431
4,843,852 A * 7/1989 Foshee et al. ..... 70/367
5,193,372 A * 3/1993 Sieg et al. ..... 70/369
5,289,708 A * 3/1994 Sieg et al. ..... 70/370
7,634,929 B2 * 12/2009 Kuhnke et al. ..... 70/375
8,240,178 B2 * 8/2012 Massard et al. ..... 70/379 R
2002/0144527 A1 * 10/2002 Dalsing et al. ..... 70/373
2005/0034496 A1 * 2/2005 Fuller ..... 70/375
2007/0209416 A1 * 9/2007 Kim ..... 70/371
2008/0072637 A1 * 3/2008 Padilla et al. ..... 70/371

* cited by examiner

*Primary Examiner* — Lloyd Gall
(74) *Attorney, Agent, or Firm* — Warner Norcross & Judd LLP

(57) ABSTRACT

A core assembly for use with a core housing of a lock assembly is defined by a bifurcated core body including interconnected first and second cylindrical members disposed in an abutting relationship. The bifurcated core body defines a first end received by an opening disposed in the core housing and a second end defining a substantially continuous surface. A slot is defined crosswise of the interconnected cylindrical members disposed between the first end and the second end of the interconnected cylindrical members. A catch is received in the slot defined by the bifurcated core body. The catch is biased outwardly from the slot for interlocking with the core housing irremovably securing the core body to the core housing.

11 Claims, 2 Drawing Sheets

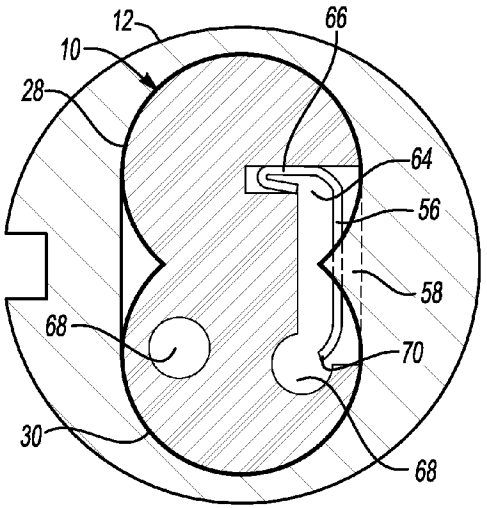
Fig-5
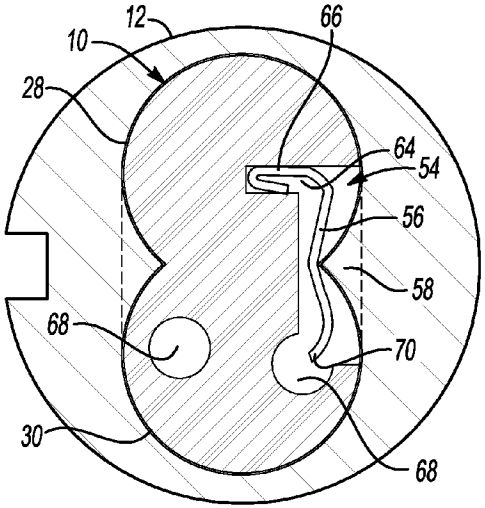
Fig-4
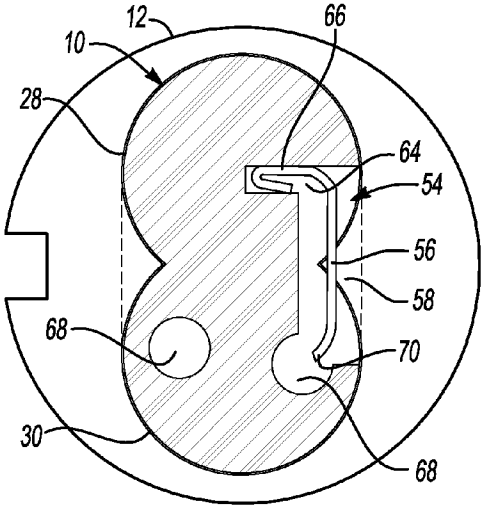
Fig-3
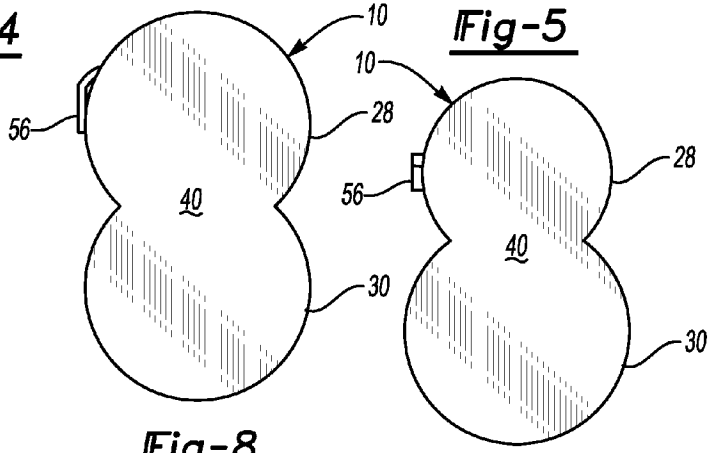
Fig-8
Fig-9
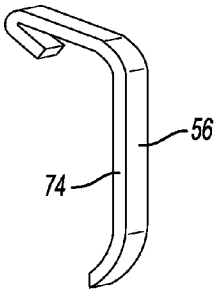
Fig-7
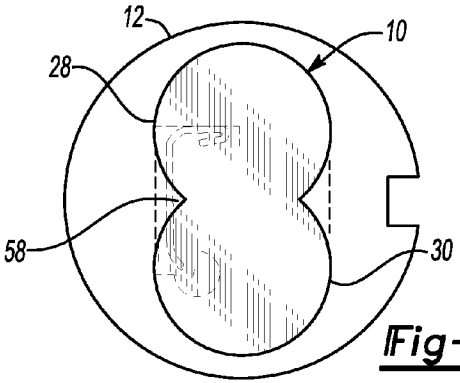
Fig-6

DUMMY LOCK CORE

PRIOR APPLICATIONS

The present application claims priority to U.S. Provisional Patent Application No. 61/834,533, filed Jun. 13, 2013.

FIELD OF THE INVENTION

The present invention relates generally to a lock cylinder. More specifically, the present invention relates to a universal dummy lock cylinder used to prevent ingress through a doorway.

BACKGROUND

Business owners and educators are subject to an increasing responsibility to secure the facilities in which business and educational services are conducted. This differs significantly from the past when it was beneficial to have numerous points of access to a facility for convenience. Therefore, many access points are being modified to prevent ingress. However, while ingress in being restricted or prevented, egress is still required for safety reasons.

Doorways that provide ingress and egress to these facilities have been outfitted with sophisticated lock systems. These lock systems each require significant modification to prevent ingress while continuing to allow egress. These modifications have proven costly in terms of manpower and mechanical modifications to lock systems. Therefore, it would be beneficial to provide a simple manner in which ingress to facilities can be prevented while maintaining existing locking features allowing egress through the same doorway.

SUMMARY

A core assembly for use with a core housing of a lock assembly includes a bifurcated core body. The bifurcated core body includes inter-connected first and second cylindrical members defining adjacent cylindrical walls. The bifurcated core body defines a first end received by an opening in the core housing and a second end defining a substantially continuous surface. A slot is defined crosswise of the interconnected cylindrical members disposed between the first and the second end of the cylindrical members. A catch is received in the slot defined by the first and second cylindrical members. The catch is biased outwardly from the slot for interlocking with the core housing irremovably securing the core body to the core housing.

The core assembly of the present invention allows for the easy replacement of a removable core of a lock assembly using a master key in a known manner and replacing the removable core assembly with a "dummy" core body preventing entry through the doorway by way of a key. Once the "dummy" core body is inserted, it is irremovable from the door exterior providing security required of modern day facilities without requiring extensive modifications to the existing lock assembly.

BRIEF DESCRIPTION OF THE DRAWINGS

Other advantages of the present invention will be readily appreciated, as the same becomes better understood by reference to the following detailed description when considered in connection with the accompanying drawings, wherein:

FIG. 3-5 show sequential steps of inserting the dummy core of the present invention into interchangeable lock housing;

FIG. 6 shows the dummy core and catch secured to an interchangeable lock housing;

FIG. 7 shows a perspective view of the catch;

FIG. 8 shows an alternate catch; and

FIG. 9 shows a further alternative catch.

DETAILED DESCRIPTION

Figure 1:
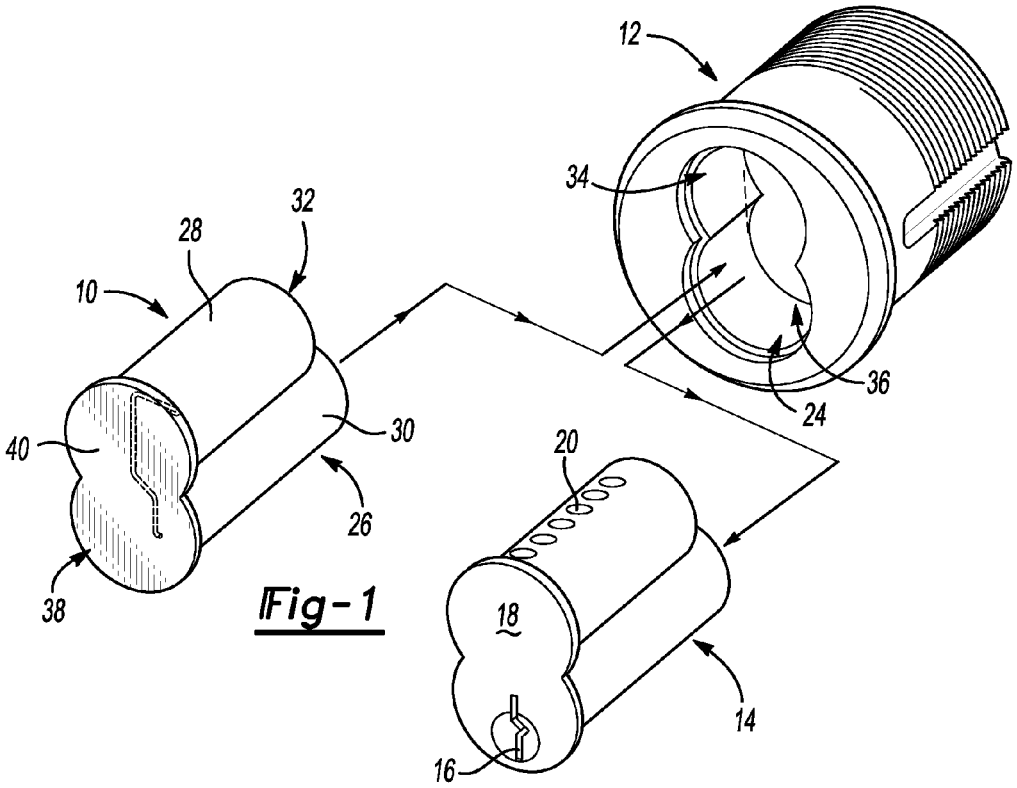
FIG. 1 shows an exploded view of one aspect of the present invention.

Referring to FIG. 1, a system by which a core 10 of the present invention is shown with lock housing 12 and a replaceable lock core 14. The removable lock core 14 includes a key way 16 disposed upon a face 18 of the removable core 14. As is known to those skilled in the art, a key (not shown) is inserted into the key way 16 actuating pins (not shown) through pin holes 20 to actuate a lock assembly (not shown).

It should also be further understood by those of ordinary skill in the art that a master key inserted into the key way 16 provides the ability to disengage the removable core 14 from the lock housing 12 by retracting a lug (not shown) into the removable core 14. Therefore, the removable core 14 is displaced from the lock housing 12 without the use of a tool.

To prevent entry into the facility with the use of a key, the core 10 of the present invention is inserted into an opening 24 vacated by the removable core 14. The dummy core 10 includes a bifurcated body 26 having a first interconnected cylindrical member 28 and a second interconnected cylindrical member 30.

The bifurcated body 26 includes a first end 32 that is received into the opening 24 of the lock housing 12. The lock housing 12 defines a first chamber 34 that receives the first cylindrical member 28 and a second chamber 36 that receives the second cylindrical member 30. The dummy core 10 includes a second end 38 defining a substantially continuous surface 40 having a similar configuration to the face 18 of the removable core 14, absent a key way.

Figure 2:
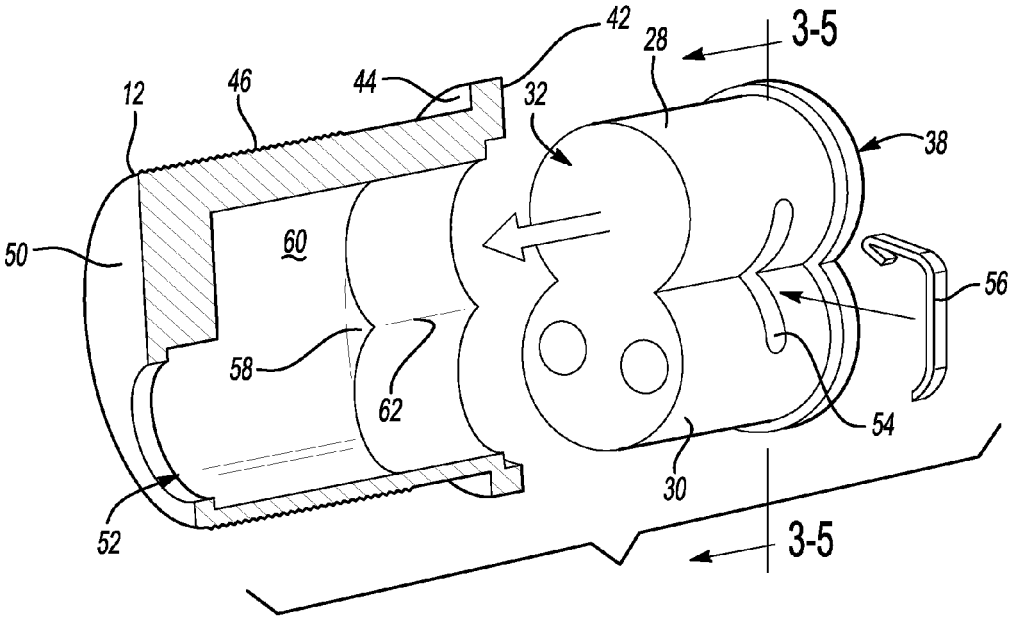
FIG. 2 shows an exploded, partial crossectional view of another aspect of the present invention.

Referring now to FIG. 2, where a partial sectional exploded view shows additional features of the present invention. The lock housing 12 includes a face plate 42 that defines a shoulder 44 that abuts a door (not shown) when the lock housing 12 is in an installed position. A plurality of threads 46 are disposed on an outer tubular surface of the lock housing 12 for threadably engaging the lock housing 12 to a lock assembly (not shown). The lock housing 12 includes a back wall 50 defining a back aperture 52. It should be understood to those of ordinary skill in the art that the locking mechanism of the lock assembly is received through the back aperture 52 of the lock housing 12.

A slot 54 is defined cross-wise of the interconnected cylindrical members 28, 30 between the first end 32 and the second end 38 of the core 10. The slot 54 receives a catch 56, as represented in FIG. 3. The catch 56 bridges the first and second cylindrical members 28, 30 and is biased outwardly from the slot 54 for interlocking with the lock housing 12 as will be explained further herein below. The catch 56 is contemplated to be a spring clip or flood resilient wire capable of maintaining an outward bias from the slot 54. Furthermore, the slot 54 is described above as merely an exemplary embodiment. It should be understood to those of ordinary skill in the art that the slot 54 may be positioned at different locations and configurations capable of interlocking with the lock housing 12.

The opening of a typical lock housing 12 includes a complementary configuration to that of the core 10. An engaging tab or stop 58 is disposed on an inner surface 60 of the lock housing 12. The engagement tab 58 is the inner termination point of lead 62 of the lock housing 12.

As shown in FIG. 1, once the removable core 14 is removed from the lock housing 12, the core 10 of the present invention is inserted into the opening 24 from which the removable core 14 leaves vacant. The core 10 is inserted without the use of tools.

FIG. 3 through 6 show sectional views of the steps by which the core 10 is inserted and the catch 56 is secured against the engagement tab 58. FIG. 3 shows the core 10 being inserted into the core housing 12 just prior to the catch 56 contacting the lead 62. FIG. 4 shows the core 10 being inserted into the lock housing 12 at a point which the lead 62 is depressing the catch 56 allowing deeper insertion of the core 10 into the lock housing 12. The catch 56 includes a camming surface 74 to assist the lead 62 with flexing or otherwise depressing the catch 56 when initially contacting the lead 62. FIG. 5 shows the core 10 fully inserted into the lock housing at which location the catch 56 is fully engaged with the lead 62 irremovably securing the core 10 in the lock housing.

The slot 54 defines an engagement channel 64 into which an extension 66 of the catch 56 is received. The engagement channel 64 contains the catch 56 in a desirable orientation in the slot 54 by way of an inference fit with the extension 66 of the catch 56. The first end 32 of the core 10 defines a channel 68 configured to receive a lock assembly (not shown) of various designs when the core 10 is inserted into the lock housing 12. It should be understood by those of ordinary skill in the art that the channel 68 takes the form of a single channel, multiple channels, or multiple configurations necessary to universally receive lock assemblies of various configurations. The receptor 68 interconnects with the slot 54. The catch 56 includes a free end 70 spaced from the extension 66 by a catch body. The free end 70 of the catch 56 extends into the receptor 68 allowing freedom of movement of the free end 70 during installation of the core 10 into the lock housing 12.

As shown in FIG. 4, the lead 62 flexes the catch 56 and forces the free end 70 of the catch 56 into the receptor 68. Subsequent to installation, the catch 56 resiliently returns to its original position in the slot 54 engaging the engagement tab 58 preventing the core 10 from being removed from the lock housing 12.

The present invention allows for a simple securement of a doorway preventing keyed entry into a facility without the use of tools. It should be understood by those of ordinary skill in the art that alternative catch configurations and slot locations are within the scope of the present invention. For example, while Corbin Ruswin replaceable core housings have been shown throughout the application, the inventive concepts are also applicable to core housing produced by Medico, Schlage, Yale and Sargent. FIGS. 8 and 9 each show a profile of two such designs. Although the profiles of these cores 10 differ from the exemplary description above, each of the features are similar. The catch 56 extends outwardly from the slot 54 at a different location. In these embodiments, the catch extends from one of the first and second cylindrical members 28, 30 at a location providing enhanced engagement to an engagement tab (not shown) applicable to alternative lock housing designs (not shown).

Obviously, many modifications and variations of the present invention are possible in light of the above teachings. The foregoing invention has been described in accordance with the relevant legal standards; thus, the description is exemplary rather than limiting in nature. Variations and modifications to the disclosed embodiment may become apparent to those skilled in the art and do come within the scope of the invention. Accordingly, the scope of the legal protection afforded this invention can only be determined by studying the following claims.

What is claimed is:

1. A core assembly for use with a core housing of a lock assembly, comprising:

a bifurcated core body comprising interconnected first and second cylindrical members disposed in an abutting relationship, said bifurcated core body defining a first end received by an opening of the core housing and a second end defining a continuous surface disposed externally to the core housing when said core assembly is received by the core housing with said continuous surface preventing keyed entry;

a slot defined crosswise of said interconnected cylindrical members disposed between said first end and said second end of said interconnected cylindrical members; and a catch received in said slot defined by said bifurcated core body, said catch biased outwardly from said slot for permanently interlocking with the core housing and irremovably securing said core body to the core housing.

2. The core assembly set forth in claim 1, wherein said catch comprises a spring clip being biased outwardly of said slot.

3. The core assembly set forth in claim 2, wherein said spring clip includes a cam face for forcing said catch inwardly of said slot during installation of said core body into the core housing.

4. The core assembly set forth in claim 2, wherein said slot defines an engagement channel for receiving an extension of said spring clip for retaining said spring clip within said slot.

5. The core assembly set forth in claim 1, wherein said first end of said bifurcated core body defines a receptor adapted to receive a plurality of lock actuators affixed to the core housing.

6. The core assembly set forth in claim 5, wherein said receptor defines a plurality of channels comprising a universal receptor.

7. The core assembly set forth in claim 1, wherein said catch engages a stop disposed upon said core housing.

8. The core assembly set forth in claim 1, wherein said slot bridges said first and said second cylindrical members.

9. The core assembly set forth in claim 1, wherein said slot is disposed in at least one of said first and said second cylindrical members comprising said bifurcated core body.

10. A core assembly for use with a core housing of a lock assembly, comprising:

a bifurcated core body comprising interconnected first and second cylindrical members disposed in an abutting relationship, said bifurcated core body defining a first end received by an opening of the core housing and a second end defining a continuous surface;

a slot defined crosswise of said interconnected cylindrical members disposed between said first end and said second end of said interconnected cylindrical members;

a catch received in said slot defined by said bifurcated core body, said catch biased outwardly from said slot for interlocking with the core housing and irremovably securing said core body to the core housing; and said first end of said bifurcated core body defines a receptor adapted to receive a plurality of lock actuators affixed to the core housing and said slot interconnects with said receptor.

11. A core assembly for use with a core housing of a lock assembly, comprising:

a bifurcated core body comprising interconnected first and second cylindrical members disposed in an abutting relationship, said bifurcated core body defining a first end received by an opening of the core housing and a second end defining a continuous surface;

a slot defined crosswise of said interconnected cylindrical members disposed between said first end and said second end of said interconnected cylindrical members;

a catch received in said slot defined by said bifurcated core body, said catch biased outwardly from said slot for interlocking with the core housing and irremovably securing said core body to the core housing; and said first end of said bifurcated core body defines a receptor adapted to receive a plurality of lock actuators affixed to the core housing, and said catch includes a free end extending from said slot into said receptor thereby allowing said catch to flex during installation of said bifurcated core body into the core housing.

* * * * *